US009650894B2

(12) United States Patent
Bülk

(10) Patent No.: US 9,650,894 B2
(45) Date of Patent: May 16, 2017

(54) VANE WITH OFFSET WALLS AND FLUID PASSAGES USED IN A VANE CELL DEVICE

(71) Applicant: Eggert Bülk, Hamburg (DE)

(72) Inventor: Eggert Bülk, Hamburg (DE)

(73) Assignee: SAETA GMBH & CO. KG, Wedel (DE)

( * ) Notice: Subject to any disclaimer, the term of this patent is extended or adjusted under 35 U.S.C. 154(b) by 186 days.

(21) Appl. No.: 14/168,641

(22) Filed: Jan. 30, 2014

(65) Prior Publication Data

US 2014/0219853 A1 Aug. 7, 2014

(30) Foreign Application Priority Data

Feb. 1, 2013 (DE) ..... 20 2013 000 976 U

(51) Int. Cl.

| | |
|---|---|
| ***F01C 21/08*** | (2006.01) |
| ***F04C 2/344*** | (2006.01) |
| ***F01C 1/344*** | (2006.01) |
| ***F04C 18/344*** | (2006.01) |

(52) U.S. Cl.

CPC ..... *F01C 21/0809* (2013.01); *F01C 1/3441* (2013.01); *F01C 1/3446* (2013.01); *F04C 2/3446* (2013.01); *F04C 18/3446* (2013.01)

(58) Field of Classification Search

CPC ..... F01C 21/0809

See application file for complete search history.

(56) References Cited

U.S. PATENT DOCUMENTS

| | | | | |
|---|---|---|---|---|
| 1,366,138 A | 1/1921 | Traudt | | |
| 3,230,840 A | 1/1966 | Hanson | | |
| 4,025,246 A * | 5/1977 | Normandin | F01C 21/0809 | 418/255 |
| 6,604,924 B2 * | 8/2003 | Schneider | F01C 21/0809 | 418/148 |
| 8,480,386 B2 * | 7/2013 | Schneider | F01C 21/0809 | 418/178 |
| 2006/0039816 A1 | 2/2006 | Cygnor | | |

FOREIGN PATENT DOCUMENTS

| | | |
|---|---|---|
| CH | 294120 | 10/1953 |
| DE | 821 156 B | 11/1951 |
| DE | 15 03 595 A1 | 7/1969 |

(Continued)

*Primary Examiner* — Mary A Davis

(74) *Attorney, Agent, or Firm* — Vidas, Arrett & Steinkraus

(57) ABSTRACT

A vane for a vane cell device comprising a stator and a rotor rotatably arranged in the stator with a plurality of guide grooves in each of which a vane can be movably mounted along a direction of movement. The vane has a high-pressure side, and a low-pressure side facing the high-pressure side, for fluid conveyed or flowing through a workspace of the vane cell device. The vane has a first side wall formed on the high-pressure side and a second side wall formed on the low-pressure side, wherein the first and second side wall are connected to each other by a plurality of ribs forming lateral limits of fluid channels. The first and second side wall are offset relative to each other so that the high-pressure side is only partially covered by the first side wall, and the low-pressure side is only partially covered by the second side wall.

11 Claims, 3 Drawing Sheets

(56) References Cited

FOREIGN PATENT DOCUMENTS

| | | | | | |
|---|---|---|---|---|---|
| DE | 15 03 330 | A1 | | 8/1969 | |
| DE | 23 11 168 | A1 | | 9/1974 | |
| DE | 43 32 540 | A1 | | 3/1995 | |
| DE | 197 03 113 | C2 | | 10/1998 | |
| FI | CH 294120 | A | * | 10/1953 | ..... F04C 2/344 |
| GB | 1 565 969 | | | 4/1980 | |
| GB | 2646635 | A | | 4/1980 | |
| JP | 2583085 | B2 | * | 2/1997 | ..... F01C 21/0809 |
| WO | 95/06819 | | | 3/1995 | |

* cited by examiner

VANE WITH OFFSET WALLS AND FLUID PASSAGES USED IN A VANE CELL DEVICE

CROSS-REFERENCE TO RELATED APPLICATIONS

This utility patent application claims priority to DE 20 2013 000 976.4, filed on Feb. 1, 2013.

STATEMENT REGARDING FEDERALLY SPONSORED RESEARCH

Not applicable.

BACKGROUND OF THE INVENTION

The invention relates to a vane for a vane cell device comprising a stator and a rotor rotatably arranged in the stator with a plurality of guide grooves in each of which a vane can be movably mounted along a direction of movement. The invention also relates to a vane cell device.

Such vane cell devices can be liquid-conveying vane cell pumps, or liquid-driven vane cell motors. Also, vane cell devices in the form of vane cell measuring devices are known in which the amount of fluid flowing through the vane cell measuring device can be determined by counting the number of rotations of the rotor taking into account the fluid volume throughput per rotation. They possess, in a manner known per se, a stator in which a rotor is rotatably arranged. The stator possesses at least one inlet opening and at least one outlet opening for the fluid. Furthermore with such vane cell devices, vanes (also termed "slide valves") are arranged in suitable guide grooves of the rotor and move back and forth radially, or primarily radially, in the guide grooves of the rotor while the vane cell device is operating. The rotor, in conjunction with the vanes, separates the low-pressure chamber from the high-pressure chamber.

It is known to fill a gap with conveying or driving fluid through corresponding channels in the rotor or vane, said gap arising during the radial movement of the vanes between the base of the guide grooves and the radially inward end of the vanes when the vanes partially move out of the drive groove. This is necessary to prevent negative pressure from arising in the arising gap which would inhibit the movement of the vane. When the vane moves back into the guide groove in a radial direction, the fluid must be able to flow out of the gap between the groove base and the vane through the fluid channels without unnecessarily impairing the vane movement.

The fluid channels formed in the rotor can be advantageously designed as fluid channels with a large cross-section. This design is however comparably expensive. The fluid channels formed in the vane can only be realized as fluid channels with a small cross-section for design reasons. This design is therefore less expensive. It is known to limit the fluid channels with ribs. The ribs must possess a sufficient thickness in order to limit the wear of the guide grooves. This also leads to the reduction of the cross-section of the fluid channels.

The small cross-section of the fluid channels formed in the vanes can generate negative pressure in the gaps between the groove bases and the vanes that increases strongly as the rotational speed of the rotor increases. This negative pressure is reinforced by rotational centrifugal force. Starting at a threshold rotational speed of the rotor, this negative pressure can undesirably inhibit the vane movement out of the rotor, or cause the liquid in the gaps between the groove bases and the vanes to outgas or evaporate which leads to an additional functional restriction and undesired noise.

BRIEF SUMMARY OF THE INVENTION

On the basis of the explained prior art, an object of the invention is to provide a vane and a vane cell device of the initially-cited type, wherein fluid channels with a larger cross-section can be formed in the vane so that the rotational speed of the rotor can be increased without impairing the vane stability or wear characteristics. In addition, vanes or respectively vane cell devices can also be cheaper to manufacture.

The invention achieves the object with a vane for a vane cell device comprising a stator and a rotor rotatably arranged in the stator having a plurality of guide grooves in each of which a vane can be movably mounted along a direction of movement, wherein the vane has a high-pressure side, and a low-pressure side facing the high-pressure side, for fluid conveyed or flowing through a workspace of the vane cell device, wherein the vane has a first side wall formed on the high-pressure side and a second side wall formed on the low-pressure side, and wherein the first and second side wall are connected to each other by means of a plurality of ribs forming lateral limits of fluid channels, and wherein the first and second side wall are offset relative to each other in the direction of movement of the vane so that the high-pressure side is only partially covered by the first side wall, and the low-pressure side is only partially covered by the second side wall.

As mentioned above, the vane cell device can for example be a fluid-conveying, in particular liquid-conveying, vane cell pump, or a fluid-driven, in particular liquid-driven, vane cell motor. It is also possible for the vane cell device to be a vane cell measuring device. In this case, the amount of fluid flowing through the vane cell measuring device, or respectively the workspace, can be determined by counting the rotor rotations taking into account the fluid volume throughput per rotation. The vane cell device comprises a fixed stator that delimits a workspace in a manner known per se. At least one inlet opening for the fluid flowing into the workspace, and at least one outlet opening for the fluid flowing out of the workspace, is provided in the wall of the workspace. A plurality of inlet openings and a plurality of outlet openings can also be provided. The fluid can for example be a liquid such as heating oil. A rotor is rotatably mounted in the stator in a manner known per se. The rotor can possess a circular cylindrical basic shape. The rotor, in conjunction with the vanes, separates the low-pressure chamber and the high-pressure chamber of the vane cell device. This design of a vane cell device is known per se.

The rotor possesses a plurality of guide grooves. A vane according to the invention (also known as a "slide valve") is accommodated in each of the guide grooves. While operating during a rotation of the rotor, the vanes move outward and inward along a direction of movement, in particular in a radial, or primarily radial, direction of movement. The vanes can therefore, for example, move within the guide grooves at an angle to the radial direction. The vanes can also be pretensioned outward so that, during the rotation of the rotor, they adapt to the changing distance between the outer surface of the rotor and the inner surface of the workspace. In particular, they are then always pressed against the inner surface of the workspace by the pretension. It is, however, also possible for the vanes to move outward solely under centrifugal force and be pressed against the inner surface of the workspace. It is furthermore possible for the opposing vanes in the rotor to be forcibly actuated by means of push rods in a known manner so that a vane entering the rotor causes the opposing vane to leave.

The vane according to the invention has a plurality of fluid channels. When the vane is in the inserted state in the rotor, the fluid channels can also run in a radial direction, or primarily radial direction, with reference to the rotary axis of the rotor. The guide grooves of the rotor each possess a radially inward groove base. When the vanes move out of the respective guide groove, fluid flows into the gap forming between the groove space and the radially inward end of the vane, in particular through the fluid channels, in order to prevent negative pressure that hinders the movement of the vane. During an inward movement of the vane, the fluid is displaced outward in a radial direction out of the gap at the groove base into the workspace, i.e., through the fluid channels in the vanes. While the vane cell device is operating, the fluid conveyed or respectively flowing through the workspace generates a pressure on the high-pressure side of the vanes according to the invention. The high-pressure side of the vanes according to the invention is hence the side at which the higher pressure predominates while the vane cell device is operating. The opposing side of the vanes according to the invention is designated the low-pressure side in this context. It is correspondingly the side on which the lower pressure predominates while the vane cell device is operating.

The vane according to the invention possesses a first side wall formed on the high-pressure side, and a second side wall formed on the low-pressure side, wherein the first and second side wall are connected by a plurality of ribs that form lateral limits of the fluid channels. The ribs can run in the direction of movement of the vanes, i.e., in the radial direction, or predominantly in the radial direction. The first and second side walls of the vane run along parallel spaced planes, for example radial planes, that simultaneously define the high-pressure and low-pressure sides of the vanes. According to the invention, the first and second side walls of the vanes are arranged offset from each other in the direction of movement of the vane, i.e., in particular in the radial, or predominantly radial, direction. The high-pressure side is therefore only partially covered by the first side wall, and the low-pressure side is only partially covered by the second side wall. In particular, the area of the low-pressure side opposite the area of the high-pressure side covered by the first side wall is not covered by the second side wall. Given this design, the fluid channels of the vane can be designed with a larger cross section in comparison to conventional vanes. The enlargement of the fluid channels is enabled by the reduction of the first and second side walls to the areas in which they are necessary for the vane to function. In particular, the first and second side walls are formed in the areas in which substantial pressure, or respectively bracing force, arises while the vane cell device is operating. Accordingly, sufficient stability of the vane can always be ensured by the first and second side walls. In the other areas not covered by the side walls, the vanes remain open at the sides. The fluid channels, laterally delimited by the ribs, are formed between the respectively opposing side wall of the vanes and the inner wall of the guide grooves of the rotor. The first and second side walls accordingly constrict the fluid channels in an alternating manner and no longer simultaneously. The cross-section of the fluid channels can therefore be designed larger by a wall thickness of the first and second side walls in comparison to when the high-pressure and low-pressure sides are completely covered by side walls. Nevertheless, the vanes according to the invention have sufficient rigidity during operation since side wall areas remain on both sides, i.e., the high-pressure and low-pressure sides.

Due to the enlargement of the cross-section of the fluid channels, the hazard of negative pressure inhibiting the movement of the vanes can be reduced. This can increase the critical rotary speed of the rotor and hence the performance of the vane cell device. At the same time, the vanes can be produced easily and economically. The enlargement of the cross-section of the fluid channels is also accompanied by a reduction in weight which results in a decrease in wear. In addition, additional vane weights can in general be economically avoided which are necessary in the prior art to compensate for greater negative pressure in the area of the groove base.

According to one design, the ribs in the section of the high-pressure side free of the first side wall can terminate flush with the outer side of the first side wall, and the ribs in the section of the low-pressure side free of the second side wall can terminate flush with the outer side of the second side wall. The ribs therefore extend up to the plane defined by the outer side of the first, or respectively second, side wall. This maximizes the cross section of the fluid channels.

According to another embodiment, the first side wall can be formed on the inner end of the vane during operation (i.e., in the state inserted in the guide grooves of the rotor of a vane cell device), in particular the radially inner end of the vane, wherein the second side wall is formed on the outer end of the vane during operation, in particular the radially outer end of the vane. A particularly effective adaptation of the side walls to the pressures acting on the vanes during operation is thereby achieved. Accordingly, the pressure exerted by the fluid on the high-pressure side of the vanes causes the vanes to be exposed to corresponding bracing forces by the side walls of the guide grooves. The bracing force acting on the high-pressure side arises in the area of the radially inner end of the vane during operation. The bracing force acting on the low-pressure side contrastingly arises in the area of the radially outer end of the vane during operation. This is reliably taken into account by the aforementioned embodiment.

Since the negative pressure arising in the gap between the groove base and the respective vane decreases exponentially with the enlargement of the fluid channel and the improvement of the corresponding flow patterns, additional vane weights can generally be dispensed with as explained above. If this is necessary in special cases, the second side wall can possess a bulge at its outer end during operation, in particular its radially outer end. An additional weight can be arranged in the bulge such as a metal element or in the form of a metal powder. If a metal element such as a metal plate or metal rod is provided as an additional weight, it can for example be cast in the bulge of the second side wall.

The vane according to the invention can be formed as a single part. The vane can be produced in a plastic injection molding method. This yields a particularly simple production of the vanes from an economical plastic.

According to another embodiment, at least some edges of the side walls and/or the ribs can be rounded and/or beveled. This enables a particularly unhindered flow of fluid. The roundings, or respectively bevels, can be realized during the plastic injection molding method by a suitable injection mold design.

The invention also achieves the object by a vane cell device comprising a stator that forms a workspace with at least one inlet opening and at least one outlet opening for a fluid, and comprising a rotor that is rotatably arranged in the workspace of the stator, wherein the rotor has a plurality of guide grooves in each of which a vane designed according to the invention is mounted, wherein a plurality of fluid channels are formed in each case between the vanes and guide grooves through which the fluid can flow between the workspace and the inner base, in particular the radially inner base, of the respective guide groove.

As mentioned, the vanes can each be pretensioned to the outside by spring means in the guide grooves of the rotor. To this end, suitable springs can for example be arranged in the area of the respective groove base. The pretension can thereby be achieved in a particularly easy manner. As mentioned above, it is however also possible for the vanes to not be pretensioned, but rather to only be moved outward by centrifugal force.

BRIEF DESCRIPTION OF THE SEVERAL VIEWS OF THE DRAWINGS

An exemplary embodiment of the invention is explained below in greater detail with reference to figures. They show schematically.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

If not otherwise specified, the same reference numbers indicate the same objects in the figures. The rotor 10 shown in FIG. 1 of the vane cell device according to the invention such as a vane cell pump, or a vane cell motor, or a vane cell measuring device, possesses a circular cylindrical basic shape with a cylindrical outer surface 12 in the portrayed example. The rotor 10 is rotatably arranged in a stator (not shown) of the vane cell device by means of bearing pins 14 of which only one can be seen in FIG. 1. The stator delimits a workspace in which the rotor 10 is rotatably mounted by the bearing pins 14, wherein the rotor 10, in conjunction with the vanes, causes a separation of the low-pressure and high-pressure chamber.

In the case of a vane cell pump, the rotor 10 is correspondingly driven rotatably in the workspace of the stator by a suitable rotary drive such as an electric drive so that fluid such as a liquid can be conveyed out of the inlet opening through the workspace toward the outlet opening. In the case of a vane cell motor, the rotary movement of the rotor 10 is caused by the fluid, such as a drive fluid, flowing through the workspace.

Figure 1:
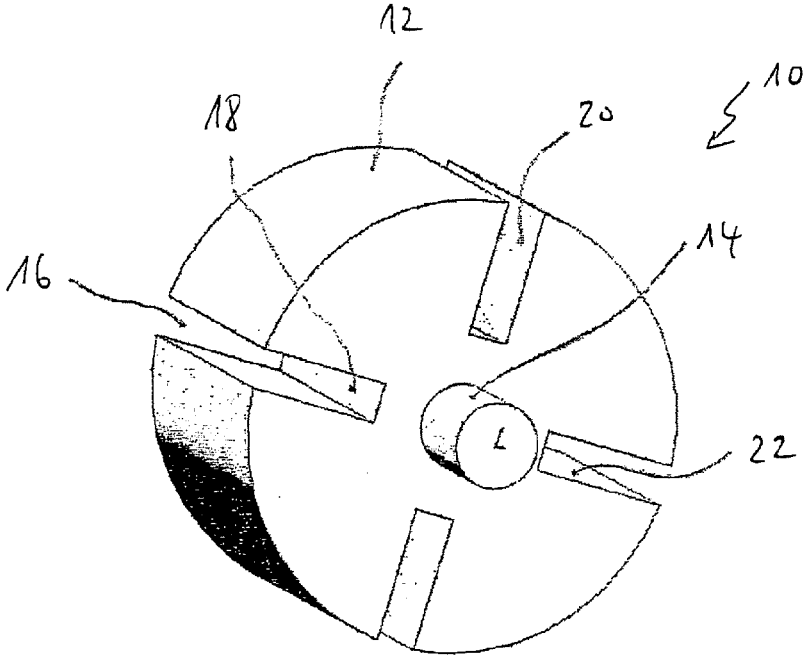
FIG. 1 A perspective view of a rotor of a vane cell device according to the invention, FIG. 2 A perspective view of a vane according to the invention, and FIG. 3 A sectional side view of the vane shown in FIG. 2 in the state inserted in the rotor shown in FIG. 1.

The rotor 10 shown in FIG. 1 possesses four guide grooves 16 in the portrayed example. In the portrayed example, the guide grooves 16 are evenly distributed over the perimeter of the rotor 10. Of course, more or less than four guide grooves can also be provided. It is also possible for the guide grooves to not be distributed evenly over the perimeter of the rotor 10. Each of the guide grooves 16 has a radially inward groove base 18 and walls 20, 22.

Figure 2:
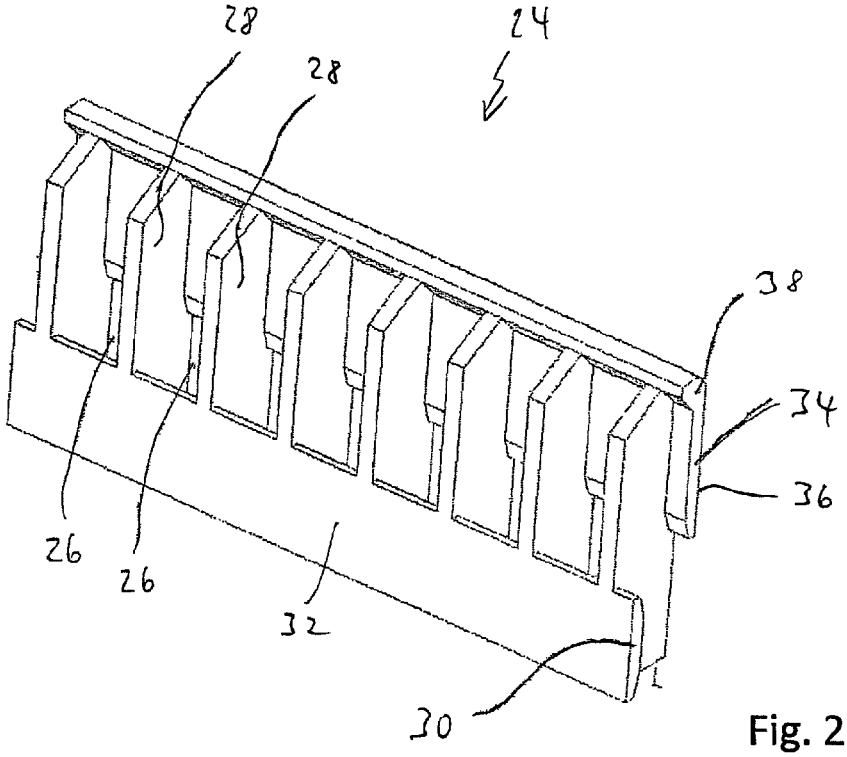

FIG. 2 shows an example of a vane 24 according to the invention of the vane cell device according to the invention. In the present case, four of the vanes 24 shown in FIG. 2 are inserted in the guide grooves 16 of the rotor 10 shown in FIG. 1. In the portrayed example, each of the vanes 24 forms a plurality of fluid channels 26 in a parallel arrangement and running in a radial direction in the state inserted in the rotor 10. The fluid channels 26 are laterally delimited on each side by ribs 28 that also run in a radial direction in the portrayed example in the state inserted in the rotor 10. In addition, the vane 24 has a first side wall 30 with an outer surface 32 that defines a high-pressure side of the vane 24 lying in a radial plane when the vane 24 is inserted in the rotor 10. In addition, the vane 24 has a second side wall 34 that diametrically opposes the first side wall 30, and its outer side 36 also defines a low-pressure side of the vane 24 lying in a radial plane when in the state inserted in the rotor 10. The first and second side walls 30, 34, and in particular their outer sides 32, 36 therefore run along parallel spaced planes.

In FIG. 2, it can be seen that the first side wall 30 and the second side wall 34 are offset relative to each other in a radial direction, i.e., in the longitudinal direction of the fluid channels 26, so that only a section of the high-pressure side is covered by the first side wall 30, and only a section of the low-pressure side is covered by the second side wall 34. In particular, the area of the low-pressure side directly opposite the first side wall 30 is not covered by the second side wall 34. Correspondingly, the section of the high-pressure side directly opposite the second side wall 34 is not covered by the first side wall 30. It can also be seen in FIG. 2 that the ribs 28 in the section of the high-pressure side that is free of the first side wall terminate at the outer side flush with the outer side 34 of the first side wall 30. It can also be seen in FIG. 2 that each of the ribs 28 in the section of the low-pressure side that is free of the second side wall terminates at the outer side flush with the outer side of the second side wall 34. The first side wall 30 is formed on the radially inner end of the vane 24 when in the inserted state in the rotor 10. The second side wall 34 is correspondingly formed on the radially outer end of the vane 24.

In the portrayed example, the vane 24 is designed as a single part from a plastic material. In particular, the vane 24 has been produced in a plastic injection molding method. Reference number 38 in FIG. 2 also indicates a bulge 38 in the second side wall 34 on its radially outer end. If necessary, an additional weight such as a metal bar or the like can be cast in this bulge 38.

Figure 3:
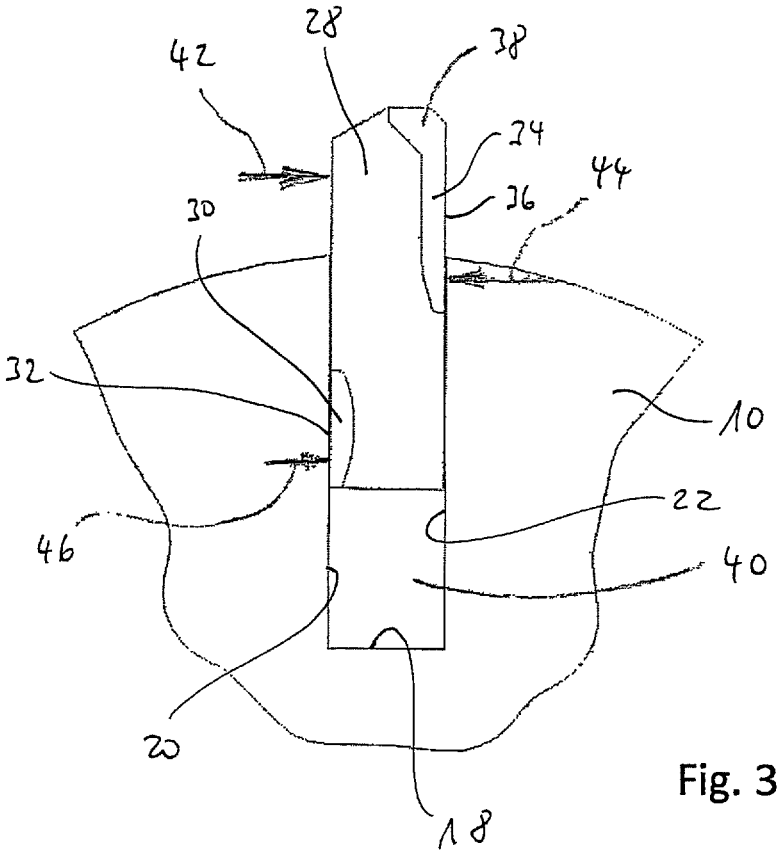

In FIG. 3, the vane 24 shown in FIG. 2 is depicted inserted in one of the guide grooves 16 of the shown section of the rotor 10 from FIG. 1. In the depicted example, the vane 24 is in a partially exited state from the guide groove 16 in a radial direction. A gap 40 is thereby formed between the radially inner end of the vane 24 and the base 18 of the guide groove 16. This gap 40 is filled with inflowing fluid when the vane 24 exits in order to prevent negative pressure. The fluid flows through the fluid channels 26 formed between the vane 24 and the walls 20, 22 of the guide groove 16 into the gap 40. When the vane 24 again moves radially inward, the fluid is displaced radially outward out of the gap 40, i.e., through the fluid channels 26.

Figure 4:
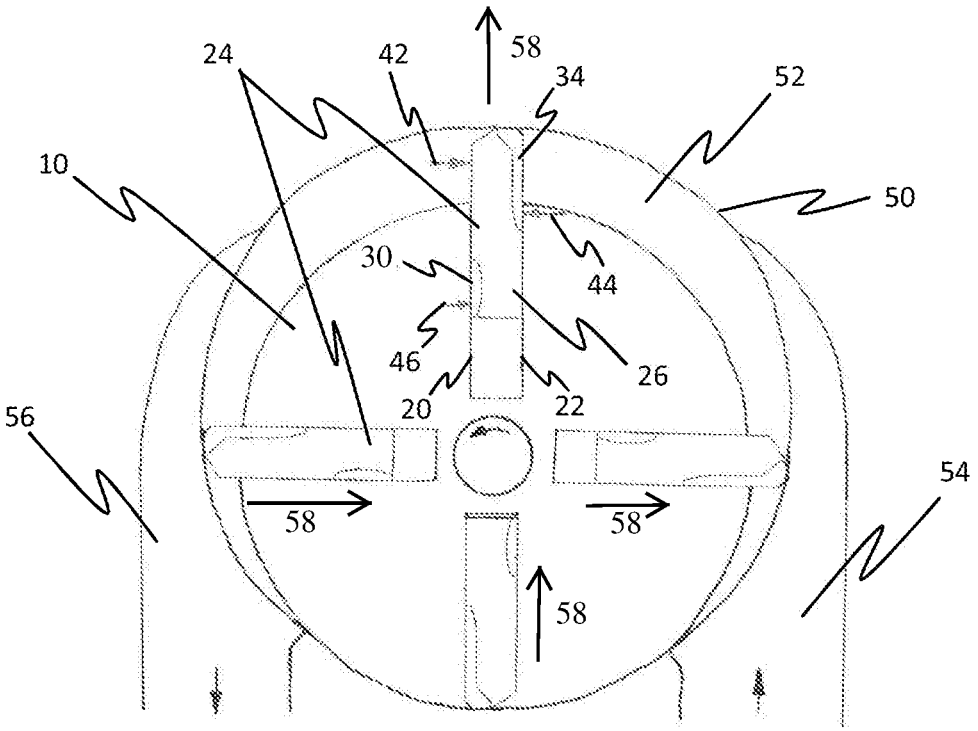
FIG. 4 shows the rotor/stator of FIG. 1, with four of the vanes of FIG. 2 in the grooves, and showing a fluid inlet and a fluid outlet to the workspace.

Referring to FIGS. 3 and 4, the fluid conveyed through the vane 24, or respectively flowing through the workspace, exerts pressure illustrated by the arrow 42 in FIGS. 3 and 4 on the high-pressure side of the vane 24. This pressure 42 causes the vane 24 to be pressed against the walls 20, 22 of the guide groove 16 corresponding to the bracing forces illustrated by the arrows 44, 46 in FIGS. 3 and 4. It can be clearly seen from the illustration in FIG. 3 that the first side wall 30 and the second side wall 34 of the vane 24 according to the invention are located where the bracing forces 44, 46 act, and where on the other hand a seal of the high-pressure side is required against the low-pressure side. It can also be seen that the first and second side wall 30, 34 of the vane 24 only alternately constrict the fluid channels 26 so that the cross-section of the fluid channels 26 can be advantageously increased. Finally, it can be seen that the edges of the first and second side walls 30, 34 are rounded and beveled in order to allow a nearly unrestricted flow of the fluid out of and into the gap 40.

FIG. 4 shows the stator 50 along with the rotor 10, shown in FIG. 1, with four of the vanes 24 shown in FIG. 2, inserted into grooves 16. The vane cell device comprises a fixed stator 50 that delimits a workspace 52. Further, at least one inlet opening 54 for the fluid flowing into the workspace 52, and at least one outlet opening 56 for the fluid flowing out of the workspace 52 is shown.

The fluid conveyed through the vane 24 exerts pressure illustrated by the arrow 42 on the vane 24. Thus, the high-pressure side of the vane 24 is defined. This pressure 42 causes the vane 24 to be pressed against the walls 20, 22 of the guide groove 16 corresponding to the bracing forces illustrated by the arrows 44, 46. The side opposite the high-pressure side, i.e. the side the bracing force indicated by arrow 44 is directed at, is the low-pressure side. The first side wall 30 and the second side wall 34 of the vane 24 according to the invention are located where the bracing forces 44, 46 act, and where on the other hand a seal of the high-pressure side is required against the low-pressure side. It can also be seen that the first and second side wall 30, 34 of the vane 24 only alternately constrict the fluid channels 26 so that the cross-section of the fluid channels 26 can be advantageously increased. The fluid channels 26 are formed as openings extending through the vanes 24 so that the fluid flows from one side of the vane 24 to the other side. The vanes 24 move into and out of the guide grooves 16 through rotation of the rotor 10 inside the stator 50 as is indicated by arrows 58.

This completes the description of the preferred and alternate embodiments of the invention. Those skilled in the art may recognize other equivalents to the specific embodiment described herein which equivalents are intended to be encompassed by the claims attached hereto.

What is claimed is:

1. A vane cell device including a stator and a rotor rotatably arranged in the stator with a plurality of guide grooves in each of which a vane can be movably mounted along a direction of movement, said vane including a first side wall having an outer surface and defining a high-pressure side of said vane, a second, opposing side wall having an outer surface and defining a low-pressure side of said vane;

wherein the first and second side wall are connected to each other by a plurality of spaced ribs forming fluid channels through said vane between said spaced ribs, and wherein the first and second side wall are offset relative to each other in the direction of movement of the vane so that the high-pressure side of said spaced ribs is only partially covered by the first side wall, and the low-pressure side of said spaced ribs is only partially covered by the second side wall.

2. The vane cell device according to claim 1, wherein the spaced ribs on said high pressure side that are not covered by said first side wall terminate flush with the outer side of the first side wall, and the spaced ribs on said low pressure side that are not covered by said second side wall terminate flush with the outer side of the second side wall.

3. The vane cell device according to claim 1, wherein the vane has a first side wall formed on an inner end of the vane, and wherein the vane has a second side wall formed on an outer end of the vane.

4. The vane cell device according to claim 1, wherein the second side wall possesses a bulge on its outer end where during operation the bulge acts as an additional weight for the vane.

5. The vane cell device according to claim 4, wherein an additional weight, in particular consisting of metal or metal powder, is arranged in the bulge.

6. The vane cell device according to claim 1, wherein the vane is formed as a single part.

7. The vane cell device according to claim 1, wherein the vane has been formed in a plastic injection molding method.

8. The vane cell device according to claim 1, wherein at least some of the edges of the side walls and/or the ribs are rounded and/or beveled.

9. A vane cell device comprising a stator that forms a workspace with at least one inlet opening and at least one outlet opening for a fluid, and comprising a rotor that is rotatably arranged in the workspace of the stator, wherein the rotor has a plurality of guide grooves in each of which a vane is movably mounted along a direction of movement, wherein a plurality of fluid channels through said vane are formed in each case between the vanes and guide grooves through which fluid can flow between the workspace and the inner base of the respective guide groove, wherein each guide groove includes the vane including a first side wall having an outer surface and defining a high-pressure side of said vane, a second, opposing side wall having an outer surface and defining a low-pressure side of said vane; wherein the first and second side wall are connected to each other by a plurality of spaced ribs forming the fluid channels between said spaced ribs, and wherein the first and second side wall are offset relative to each other in the direction of movement of the vane so that the high-pressure side of said spaced ribs is only partially covered by the first side wall, and the low-pressure side of said spaced ribs is only partially covered by the second side wall.

10. The vane cell device according to claim 9, wherein said rotor and vanes are positioned in a vane cell pump or a vane cell motor.

11. A vane for use in a vane cell device that includes a stator and a rotor rotatably arranged in the stator, the rotor having a plurality of guide grooves, said vane comprising:

a plurality of spaced ribs forming fluid channels between said spaced ribs, said spaced ribs having a high pressure side and a low pressure side said vane including a first side wall having an outer surface attached to a portion of said spaced ribs on their high pressure side and defining a high-pressure side of said vane, a second opposing side wall having an outer surface attached to a portion of said spaced ribs on their low pressure side and defining a low-pressure side of said vane;

wherein the first and second side walls are offset relative to each other so that the high-pressure side of said spaced ribs is only partially covered by the first side wall, and the low-pressure side of said spaced ribs is only partially covered by the second side wall.

* * * * *